US007563499B2

(12) United States Patent
Poulakis

(10) Patent No.: US 7,563,499 B2
(45) Date of Patent: Jul. 21, 2009

(54) ADHESIVE CLOSING PART

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 302 days.

(21) Appl. No.: 10/570,275

(22) PCT Filed: Jul. 23, 2004

(86) PCT No.: PCT/EP2004/008215

§ 371 (c)(1),
(2), (4) Date: Oct. 18, 2006

(87) PCT Pub. No.: WO2005/023041

PCT Pub. Date: Mar. 17, 2005

(65) Prior Publication Data

US 2007/0154679 A1 Jul. 5, 2007

(30) Foreign Application Priority Data

Sep. 6, 2003 (DE) ..... 103 41 151

(51) Int. Cl.
*A44B 18/00* (2006.01)

(52) U.S. Cl. ..... 428/99; 428/100; 428/900; 24/306; 24/442; 24/443; 24/452

(58) Field of Classification Search ..... 428/99, 428/100, 34.1, 900, 36.1, 36.9; 24/306, 442, 24/443, 452
See application file for complete search history.

(56) References Cited

U.S. PATENT DOCUMENTS

| | | | | |
|---|---|---|---|---|
| 5,942,177 | A | 8/1999 | Banfield | |
| 2003/0108707 | A1 * | 6/2003 | McMahon | 428/36.9 |

FOREIGN PATENT DOCUMENTS

| | | |
|---|---|---|
| DE | 100 39 940 | 3/2002 |
| EP | 0 621 118 | 10/1994 |

* cited by examiner

*Primary Examiner*—Alexander Thomas
(74) *Attorney, Agent, or Firm*—Roylance, Abrams, Berdo & Goodman, L.L.P.

(57) ABSTRACT

An adhesive closing part includes a support band (10) provided with hooking elements (12) arranged on the supporting band and a cover band (16) that covers the support band (10) on the side facing away from the hooking elements (12). The cover band is wider than the support band (10) such that free lateral edge zones of the cover band (16) extend beyond the associated longitudinal edges of the support band (10) on both sides. The two free lateral edge zones are folded back in the direction of the rear face of support band (10) to form one respective accommodating space (20), while being interconnected, such that a tubular member (22) is formed at least by parts is formed at least by parts of the cover band (16). This structure results in a reliably functioning sealing option for the hooking elements.

20 Claims, 1 Drawing Sheet

ADHESIVE CLOSING PART

FIELD OF THE INVENTION

The present invention relates to an adhesive closing part having a support strip with interlocking elements mounted on it and having a cover strip on the side facing away from the interlocking elements covering the support strip. The cover strip is wider than the support strip so that free side edge areas of the cover strip extend on both sides beyond the associated longitudinal edges of the support strip.

BACKGROUND OF THE INVENTION

Adhesive fastener elements are employed for a variety of purposes, such as in automotive technology, flooring technology and clothing of all kinds, and for special applications in mechanical engineering. Adhesive fastener elements have proved themselves to be reliable detachable connection and fastening elements in these fields. When such adhesive fastener elements are used for aircraft or motor vehicle passenger seats, they fasten seat covers to foamed parts. Some adhesive fastener elements are foamed into the foam upholstery material during production of the respective seat, while another, mating adhesive fastener element with the corresponding interlocking elements is fastened to the cover upholstery material, in particular is sewn on. For producing the foam body element, the adhesive fastener elements are introduced into so-called seating pipes of a foam injection mold. By introduction of foam material into the free cross-sections of the foam injection mold, preferably one of polyurethane (PU) foam, the adhesive fastener elements are fastened on the foam body elements in the foam injection process. The pipes employed normally project above the other walls of the foam injection mold and thus later form groove-like recesses in the foam body element that is then engaged in the upholstery cover material with the other corresponding adhesive fastener element. In this way, geometric seam and shape patterns may be produced on a particular seat.

DE-A-199 56 011 discloses an adhesive fastener element for this purpose in the seating area. The adhesive fastener element has a support strip and interlocking elements mounted on the support strip. The support strip has at least one reinforcing element resistant to bending and extending preferably along the support strip in the form of a bending wire. Application of the solution disclosed results in better embedding properties in foam molds for adhesive fastener elements. Because of the flexural strength of the reinforcing element, once adhesive fastener elements have been introduced into the respective foam injection mold, they remain in their position. The disclosed cover strip is applied in one layer to be flush with the upper side of the foam injection mold. During the foam injection process involving polyurethane foam (PU), the foam may raise the cover strip above the side edges of the foam injection mold and reach the interior of the duct-like injection mold in which the support strip with the bending wire and the interlocking elements is seated. However, penetration of the intermediate areas of the interlocking elements by the foam weakens the fastening capability of these elements. They may then not be effective when engaged with corresponding closing elements of the other component. The penetration reduces the adherence of the disclosed adhesive fastener elements.

In order to offset this disadvantage, DE-A-100 39 940 proposed, for a generic adhesive fastener element, a cover strip wider than the support strip. The two free side edge areas of the cover strip are each folded back themselves in the direction of the support strip along a fold line extending in the longitudinal direction. The end edges of the free side edge areas of the cover strip then face the longitudinal edges of the support strip. As a result, the cover strip has on both sides a sealing lip always extending along the area having the interlocking elements and being adjacent to the wall elements of the foam injection mold enclosing the molding depression in which the interlocking elements are received during the foaming process. The foam material introduced into the foam injection mold causes this sealing lip to be pressed against the facing wall elements of the mold. As a result of the certain amount of flexibility in the area of the fold line, the sealing lip rests against the wall areas forming the sealing surface so that the improvement desired in the sealing action as foam barrier is achieved. To impart a certain amount of flexural resistance to the adhesive fastener element, something perceptibly improving handling during introduction into the foam injection mold, this disclosed solution also has a flexurally-resistant element in the form of a bending wire.

Unintentional penetration of foam material in the direction of the interlocking elements may occur even with these disclosed solutions despite this sealing lip configuration. It has been found in particular that the previously disclosed sealing solution encounters its limits where the foam injection mold has no molding depression (cost-intensive in production) for reception of the interlocking elements of the adhesive fastener element.

Since both of the previously disclosed solutions have recesses in the foam injection pipe to receive the interlocking elements, problems also arise in surface cleaning of the mold, since fouling matter may unintentionally settle there.

SUMMARY OF THE INVENTION

An object of the invention is to provide improved adhesive fastener elements so that, while the advantages of conventional adhesive fastener elements are retained, they have an even better effect in sealing of the mold foam to be introduced into a foam injection mold and may be adapted to the geometric patterns of a specified foam injection mold having no mold depression or recess to receive the interlocking elements during the foam injection process.

This object is basically attained by an adhesive fastener element having a support strip with interlocking elements on one side and having a cover strip on an opposite side of the support strip.

The cover strip is wider than the support strip and has two free side edge areas folded back in the direction of the rear side of the support strip so that a reception space is formed in each of the areas and so that the two areas are interconnected. A reliably functioning option is then achieved for sealing the interlocking elements from the mold foam. The respective sealing system may be reliably introduced by an operator by simple means into the associated foam injection mold. The adhesive fastener element of the present invention has been found to be advantageous for foam injection molds (foam injection pipes) where the upper side is essentially level, and in particular extends horizontally when in the use position. In the respective molding tool configuration, the interlocking elements may then be positioned on the upper side of the foam injection mold, and nevertheless may be reliably sealed in the side edge area by the mounting of the cover strip configured as a hose element. This adhesive fastener element is space-saving and cost-effective, especially with respect to production technology. In addition, the production costs for the respective foam injection mold may be reduced, since this mold no longer need have the otherwise customary groove-like recesses for mounting the interlocking elements. Handling of the adhesive fastener element and its introduction into the foam injection mold are facilitated for a person operating the foam injection device. Cleaning is made easier by the smooth surface of the top of the foam injection mold.

The hose element may be made exclusively of parts of the cover strip molded around the recesses. The cover strip is then in the form of an annular element. It is also possible, however, to produce an open hose element. The free ends of the side edge areas, on the rear side of the support strip with the interlocking elements, are fastened on the cover strip layer between them, by a suitable adhesive, for example.

In another preferred embodiment of the adhesive fastener element of the present invention, the cover strip is connected to the support strip by an adhesive. The parts of the cover strip extending along the rear side of the support strip facing away from the interlocking elements are also joined to each other by an adhesive. Durable interlocking of the individual layers of the adhesive fastener element is thereby achieved.

In another especially preferred embodiment of the adhesive fastener element of the present invention, the cover strip, the support strip, the interlocking elements, and/or the adhesive at least to some extent possess ferromagnetic properties. The adhesive fastener element may then be held in place on the foam injection mold by a magnetic retaining unit, such as one in the form of permanent magnet strips in the foam injection mold or in the seating pipe of the foam injection mold. Such magnetic strips retain the strip-like adhesive fastener element when aligned.

To impart a certain amount of bending resistance to the adhesive fastener element, something which definitely facilitates handling of the adhesive fastener element when it is introduced into the foam injection mold or the foam injection pipe, especially if specified lengths of the adhesive fastener element are to be introduced into the respective foam injection mold in complex three-dimensional structures, in one preferred embodiment of the adhesive fastener element of the present invention, a binding wire is introduced into the respective reception space inside the hose element. The bending wire possesses ferromagnetic properties and accordingly is a component of the ferromagnetic fastening system. As a result of use of the ferromagnetic stiffening wire along each of the longitudinal edges of the hose element which form the receptacle, fixing of the adhesive fastener element in place on the foam injection mold is effected, and the system of the present invention for sealing the interlocking elements from the mold foam is created.

The interlocking elements of the adhesive fastener element of the present invention may be in the form of stalk-shaped, hooked, looped, fleece-like, or mushroom-shaped adhesive fastener elements.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are not drawn to scale.

DETAILED DESCRIPTION OF THE INVENTION

Figure 1:
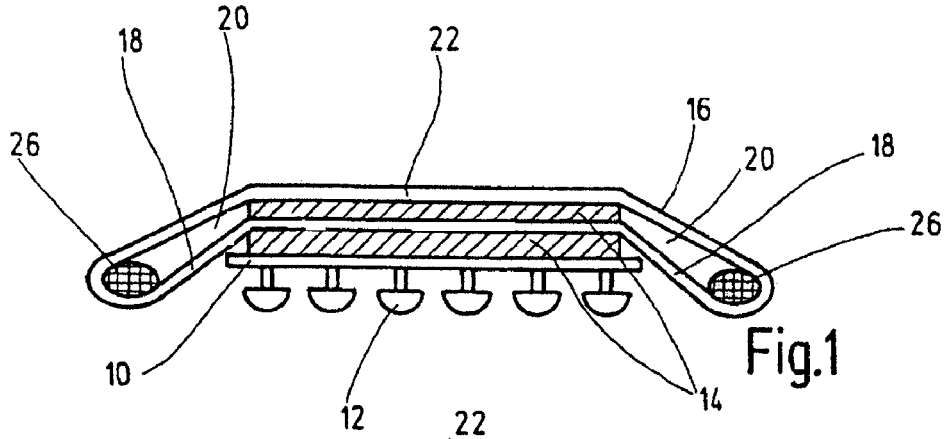
FIG. 1 is a front elevational view in section of an adhesive fastener element according to an exemplary embodiment of the present invention.

The adhesive fastener element of the present invention has a support strip 10. Interlocking or fastener elements 12 are mounted side by side and one behind the other on one side of the support strip 10. For example, the adhesive fastener element may be a microfastener in which 200 to 400 interlocking elements per square centimeter are provided on a support strip 10 of a thickness of 0.1 mm to 0.3 mm. An exemplary process for production of the support strip 10 of such a microfastener is disclosed in DE-C-198 28 856. In this disclosed process, a thermoplastic material is introduced by an extrusion tool into the gap between a pressure tool and a molding tool. A sieve having through openings is used as shaping element. The interlocking elements are in the form of plastic setting at least to some extent in the holes in the sieve. In addition to the sieve molding process, a different extrusion or casting process may be applied for production of the support strip 10 with interlocking elements 12.

As shown in the drawing figures, an adhesive is applied to the rear side of the support strip 10. This laminar adhesive means or layer 14 may comprise, for example, of a moisture-crosslinking polyurethane (PU), an acrylate adhesive or other suitable adhesive. The adhesive means 14 essentially covers one side of the support strip 10, and is rigidly connected to it. A cover strip 16 is rigidly connected to the support strip 10 by the laminar adhesive means or layer 14. The pertinent cover strip 16 is designed to be wider than the support strip 10 so that the free side edge areas 18 of the cover strip 16 extend on both sides beyond the associated longitudinal edges of the support strip 10. In addition, the two free side edge areas 18 are folded or extend back in the direction of the rear side of the support strip 10 each forming a reception space or closed loop 20 in the direction of the rear side of the support strip 10. The free side edge areas 18 are interconnected toward the rear so that a hose element 22 is formed at least by parts of the cover strip.

In the present embodiment, the hose element 22 is closed on itself and accordingly forms an annular element. The parts of the cover strip 16 extending over the rear side of the support strip 10 facing away from the interlocking elements 12 are also interconnected by an adhesive means or layer 14. A stack is then made up in sequence of adhesive means 14, parts of the cover strip 16, additional adhesive means 14, and other parts of the cover strip 16 on the rear side of support strip 10. The width of the cover strip employed may be specified as determined by requirements. Its configuration is based on the cross-sectional shapes, and especially the widths, of the respective foam injection pipe 24 as form mold element (see FIG. 2).

The cover strip 16 is formed of a textile material, a nonwoven fabric, or a plastic fabric, preferably one with open pores, to achieve good adhesion of the foam to the cover strip. Reliable bonding of the adhesive fastener element to the molded foam element (not shown) is thereby obtained. The interlocking elements 12 are in any event available for engagement free of foam with corresponding elements of another adhesive fastener element. A bending wire 26 possessing ferromagnetic properties is integrated into both sides of the pocket-shaped recesses 20. This bending wire could however, also be replaced in the recess 20 by a medium not shown (powdered iron or the like) also possessing ferromagnetic properties. The respective configuration of an adhesive fastener element is essentially resistant to bending because of the bending wire feature. Otherwise it is entirely flexible with regard to the other components employed, and may be bent in its longitudinal direction and accordingly also forward and backward.

Figure 2:
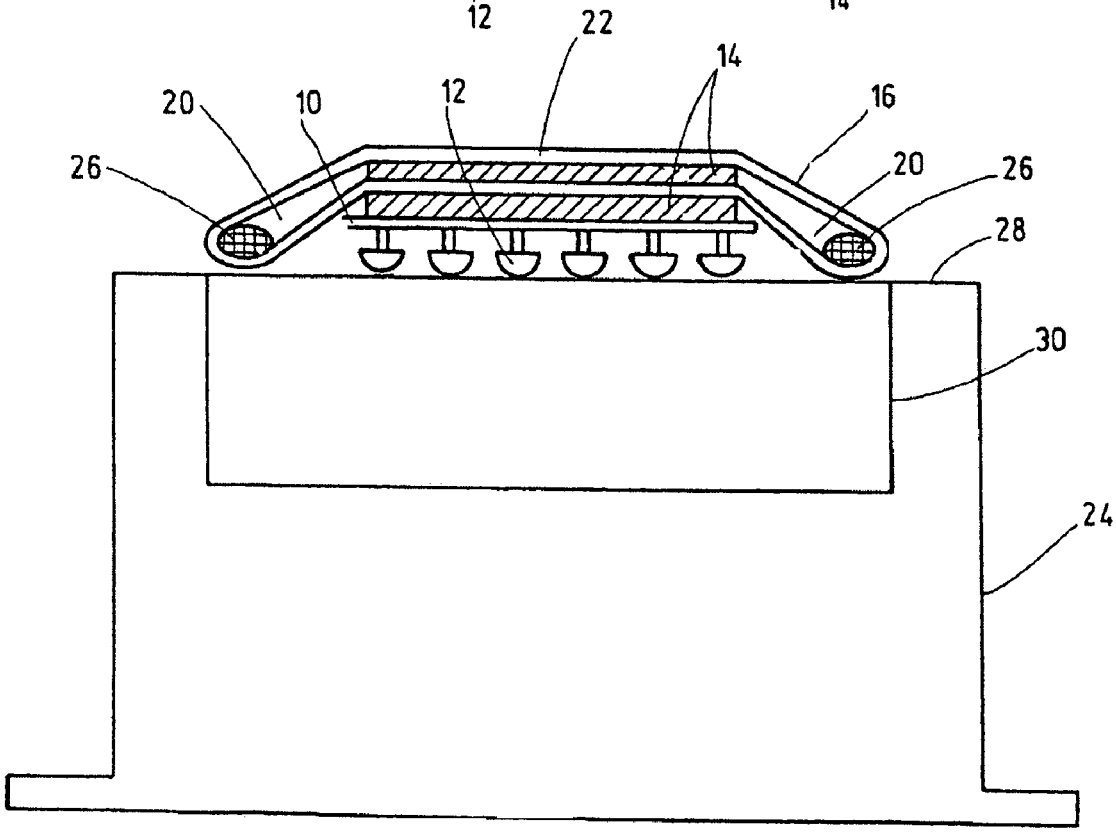
FIG. 2 is a front elevational view of a part of a foam injection mold (foam injection pipe) with the adhesive fastener element of FIG. 1 on it in the use position.

The illustration in FIG. 2 relates to use of an adhesive fastener element shown in FIG. 1. Part of the foam injection mold of a molding tool, also referred to in technical language as foam injection pipe 24, is shown in cross-section in FIG. 2. The foam injection pipe 24 has a level bottom surface or upper side 28. On this upper side of the foam injection pipe 24, a bar-shaped magnet element 30 operate in conjunction with the corresponding components of the adhesive fastener element shown in FIG. 1. In addition to use of the pair of bending wires 26, the cover strip 16 and/or the support strip 10 and/or the interlocking elements 12 and/or the adhesive means 14 at least to some extent possess ferromagnetic properties. The iron particles used for this purpose are preferably integrated into the respective component of the adhesive fastener element and/or may be applied to the respective component in the form of a coating. In addition, a ferromagnetic powder may be applied in the form of a coating paste. Depending on the components of the adhesive fastener element undergoing ferromagnetic treatment as described, preferably full-surface contact with the magnet element 30 of the foam injection pipe 24 is obtained.

As illustrated in FIG. 2, the adhesive fastener element of the present invention as described in the foregoing is applied so that the two side edge areas extend at an angle of approximately 30° to 45° downward in the direction of the interlocking elements 12 and are held in position by the magnetic force between magnetic element 30 and associated bending wire 26. This arrangement results in a beaded sealing lip formed by deflection of the cover strip in the area of the two reception spaces 20. This sealing lip exerts a high sealing force preventing the foam material entering the foam injection mold from advancing in the direction of the interlocking elements 12. The geometric size selected for the hose element 22 is such that the free ends of the interlocking elements 12 are always reliably covered. Since the elements of the cover strip 16 are oriented in the direction of the respective laminar adhesive means 14 so as to move toward each other in the form of a gap and spaced at a distance from each other, a favorable introduction of force is exerted on the bending wires 26 by the magnetic force. This force presses the stack package as a whole, including the support strip 10 with interlocking elements 12, in the direction of the foam injection pipe 24, so that sealing on the edges is achieved by way of the interlocking elements.

The adhesive fastener element of the present invention is especially well suited for aircraft or motor vehicle passenger seats. It serves the purpose of fastening seat covers on foam elements. Adhesive fastener elements are foamed into the foam upholstery material in production of a particular seat. The adhesive fastener element is then fastened on the upholstery cover material with the corresponding interlocking elements. Individual pot-like or strip-like magnetic elements may be introduced into the foam injection pipe 24 in place of the full-surface magnet element configuration 30 shown in FIG. 2. However, to ensure a reliable sealing effect, it is important for the bending wire 26 or other ferromagnetic medium of the reception space 20 to be attracted by the foam injection mold 24 by magnetic means.

While one embodiment has been chosen to illustrate the invention, it will be understood by those skilled in the art that various changes and modifications can be made therein without departing from the scope of the invention as defined in the appended claims.

The invention claimed is:

1. An adhesive closing part, comprising:

a support strip having opposite first and second strip sides and first and second strip side edges;

interlocking elements extending from said first strip side; and a cover strip on said second strip side and covering said support strip, said cover strip being wider than said support strip and having cover side edge areas extending laterally beyond said strip side edges, said cover side edge areas being folded back in a direction of said support strip forming a reception space in each of said cover side edge areas, said cover side edge areas being connected forming a hose element configured as a closed annular element by parts of said cover strip.

2. An adhesive closing part according to claim 1 wherein said cover strip is joined to said support strip by adhesive; and said parts of said cover strip extend over said second strip side and are joined by adhesive.

3. An adhesive closing part according to claim 2 wherein at least one of said cover strip, said support strip, said interlocking elements and said adhesive possess ferromagnetic properties.

4. An adhesive closing part according to claim 1 wherein said cover strip comprises one of the group consisting of textile material, non-woven material and plastic material; and said interlocking elements comprise one of the group consisting of polyamide and polypropylene.

5. An adhesive closing part according to claim 1 wherein said support strip with said interlocking elements is produced by one of an extrusion process and a molding process.

6. An adhesive closing part according to claim 1 wherein at least one of said cover strip, said support strip, and said interlocking elements possess ferromagnetic properties.

7. An adhesive closing part according to claim 1 wherein each said reception space receives a medium possessing ferromagnetic properties.

8. An adhesive closing part according to claim 7 wherein said medium comprises a bending wire.

9. An adhesive closing part, comprising:

a support strip having opposite first and second strip sides and first and second strip side edges;

interlocking elements extending from said first strip side; and a cover strip joined on a said second strip side by adhesive and covering said support strip, said cover strip being wider than said support strip and having cover side edge areas extending laterally beyond said strip side edges, said cover side edge areas being folded back in a direction of said support strip forming a reception space in each of said cover side edge areas, said cover side edge areas being connected forming a hose element by parts of said cover strip extending over said second side and being joined by adhesive.

10. An adhesive closing part according to claim 9 wherein said cover strip comprises one of the group consisting of textile material, non-woven material and plastic material; and said interlocking elements comprise one of the group consisting of polyamide and polypropylene.

11. An adhesive closing part according to claim 9 wherein said support strip with said interlocking elements is produced by one of an extrusion process and a molding process.

12. An adhesive closing part according to claim 9 wherein at least one of said cover strip, said support strip, said interlocking elements and said adhesive possess ferromagnetic properties.

13. An adhesive closing part according to claim 9 wherein each said reception space receives a medium possessing ferromagnetic properties.

14. An adhesive closing part according to claim 13 wherein said medium comprises a bending wire.

15. An adhesive closing part, comprising:

a support strip having opposite first and second strip sides and first and second strip side edges;

interlocking elements extending from said first strip side; and a cover strip on said second strip side and covering said support strip, said cover strip being wider than said support strip and having cover side edge areas extending laterally beyond said strip side edges, said cover side edge areas being folded back in a direction of said support strip forming closed loops along and depending from each of said cover side edge areas and extending over said strip side edges.

16. An adhesive closing part according to claim 15 wherein said cover strip is joined to said support strip by adhesive; and said parts of said cover strip extend over said second strip side and are joined by adhesive.

17. An adhesive closing part according to claim 15 wherein said cover strip comprises one of the group consisting of textile material, non-woven material and plastic material; and said interlocking elements comprise one of the group consisting of polyamide and polypropylene.

18. An adhesive closing part according to claim 15 wherein at least one of said cover strip, said support strip and said interlocking elements possess ferromagnetic properties.

19. An adhesive closing part according to claim 15 wherein each said closed loop receives a medium possessing ferromagnetic properties.

20. An adhesive closing part according to claim 19 wherein said medium comprises a bending wire.

* * * * *